US006901937B2

(12) United States Patent
Sebban

(10) Patent No.: US 6,901,937 B2
(45) Date of Patent: Jun. 7, 2005

(54) MAKE-UP TYPE CASE COMPRISING AN ARTICULATED LID

(75) Inventor: Jacques Sebban, Orléans (FR)

(73) Assignee: L'Oréal, Paris (FR)

( * ) Notice: Subject to any disclaimer, the term of this patent is extended or adjusted under 35 U.S.C. 154(b) by 160 days.

(21) Appl. No.: 09/979,984

(22) PCT Filed: May 22, 2001

(86) PCT No.: PCT/FR01/00876

§ 371 (c)(1),
(2), (4) Date: Jan. 16, 2002

(87) PCT Pub. No.: WO01/72166

PCT Pub. Date: Oct. 4, 2001

(65) Prior Publication Data

US 2002/0157684 A1 Oct. 31, 2002

(30) Foreign Application Priority Data

Mar. 29, 2000 (FR) ..... 00 03969

(51) Int. Cl.[7] ..... A45D 33/00

(52) U.S. Cl. ..... 132/301; 132/293; 206/581

(58) Field of Search ..... 132/293, 294, 132/295, 296, 298, 300, 301, 312, 314, 315, 316; 206/45.2, 45.23, 581, 587, 823, 235, 37, 38, 261, 263, 269, 268; 220/817, 822, 824, 837, 843, 844, 848

(56) References Cited

U.S. PATENT DOCUMENTS

| | | | | |
|---|---|---|---|---|
| 391,145 | A | 10/1888 | Hardin | |
| 1,488,282 | A | 3/1924 | Phillips | |
| 1,613,536 | A | 1/1927 | Rose | |
| 1,688,042 | A * | 10/1928 | Gaess | 220/4.22 |
| 1,824,451 | A * | 9/1931 | Soss | 200/40.38 |
| 2,546,590 | A * | 3/1951 | Ferrel | 16/302 |
| 3,741,430 | A | 6/1973 | Bergh et al. | |
| 3,952,369 | A * | 4/1976 | Erickson | 16/265 |
| 4,119,240 | A | 10/1978 | Dumas et al. | |
| 4,195,650 | A * | 4/1980 | Ullmann et al. | 132/294 |
| 4,420,079 | A | 12/1983 | Gliniorz et al. | |
| 4,666,036 | A | 5/1987 | Bourbon | |
| 4,684,017 | A * | 8/1987 | Watanabe et al. | 206/235 |
| 4,840,288 | A | 6/1989 | Lunderman et al. | |
| 5,078,159 | A | 1/1992 | Yuhara | |
| 5,325,984 | A * | 7/1994 | Ady et al. | 220/817 |
| 5,353,947 | A | 10/1994 | Zinnbauer et al. | |
| 5,568,820 | A | 10/1996 | Dirksing | |
| 5,638,839 | A | 6/1997 | Montoli | |
| 5,769,253 | A | 6/1998 | Gross | |
| 5,845,366 | A * | 12/1998 | Kuroda | 16/229 |
| 6,014,978 | A | 1/2000 | Yuhara | |
| 6,286,521 | B1 | 9/2001 | Joulia | |

FOREIGN PATENT DOCUMENTS

| | | |
|---|---|---|
| FR | 2 651 975 | 3/1991 |
| JP | S60-151412 | 10/1985 |
| JP | H3-49706 | 5/1991 |
| JP | H11-299536 | 11/1999 |

OTHER PUBLICATIONS

Co–pending U.S. Appl. No. 09/980,254; Title: Make–Up Type Housing Comprising An Articulated Lid Inventor: Jacques Sebban; filed Nov. 29, 2001.

* cited by examiner

*Primary Examiner*—Eduardo C. Robert
*Assistant Examiner*—David Comstock
(74) *Attorney, Agent, or Firm*—Finnegan Henderson Farabow Garrett & Dunner, L.L.P.

(57) ABSTRACT

This application relates to a case (1) comprising a bottom (2) and a lid (4) capable, at least prior to first use, of pivoting with respect to the bottom so as to be positioned underneath the latter, the bottom (2) being hinged about a first axis ($A_1$) with respect to an intermediate element (20), the latter being hinged with respect to the lid (4) about a second axis ($A_2$), locking means ($B_1$, $B_2$, C) being capable of locking the lid (4) with respect to the intermediate element (20) when the latter pivots with respect to the bottom (2) about the axis ($A_1$), and of locking the bottom (2) with respect to the intermediate element (20) when the latter pivots with respect to the lid (4) about the axis ($A_2$).

29 Claims, 6 Drawing Sheets

MAKE-UP TYPE CASE COMPRISING AN ARTICULATED LID

Figure 1A:
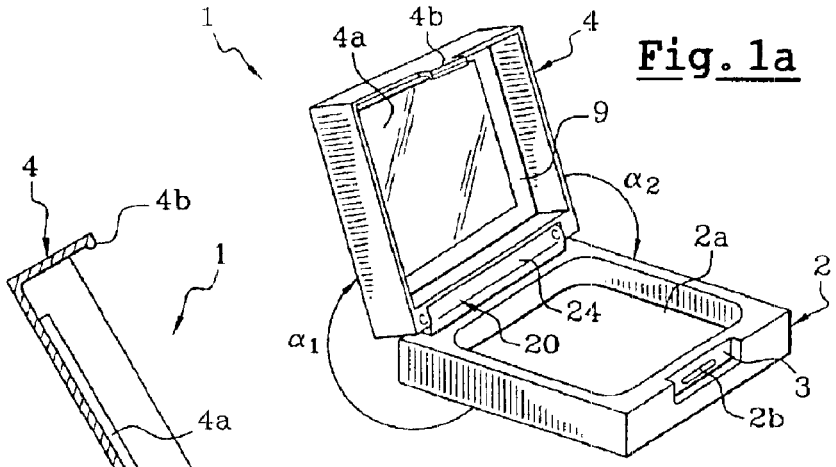

The present invention relates to a case, particularly of the makeup case type, which can be closed by a hinged lid. Such a makeup case generally comprises two parts, a bottom and a lid, hinged one on the other, by means of at least one hinge. In general, this case is intended to contain one or more friable products of pasty, liquid or pulverulant consistency, such as an eyeshadow, a rouge, a blusher or a foundation. Customarily, cases are marketed with the product it contains offered in a broad range of different shades.

Hence, the consumer, in order to be able to choose makeup of the desired shade, is frequently obliged to take the case out of its packaging and open it to check the colour of the product.

With a view to seeing, at the point of sale, the shade of a makeup product, immediately, document U.S. Pat. No. 5,568,820 proposes a makeup case, the structure of which allows the lid to be pivoted through 360° with respect to the bottom so as to place the lid underneath the bottom of the case. In this position, the case can be packaged in transparent packaging, of the blister pack kind, or of the heat shrink film kind. Hence, the case can be displayed in boutiques or shops and occupy the minimum amount of space.

In the aforementioned document, the connection between the bottom and the lid is by a multiple hinge structure. Specifically, the bottom of the case according to document U.S. Pat. No. 5,568,820 is hinged to an intermediate element by means of a hinge with an attached hinge pin, the lid for its part being hinged to this intermediate element by a film hinge. At the time of first closure of the case by the user, the intermediate element is immobilized with respect to the lid, so that the film hinge is inoperative during opening/closing operations performed during the remainder of the time that the case is in use.

The structure of the case according to document U.S. Pat. No. 5,568,820 has a certain number of disadvantages. Specifically, when the lid is connected to the intermediate element by a film hinge, the lid has a tendency to move elastically away from its position of maximum opening under the bottom of the case and to return to the position in which the lid and the intermediate element were moulded. As a result, the lid is not satisfactorily positioned under the bottom.

In actual fact, the foregoing occurs frequently, because of the elastic properties of the material used to produce the parts which are joined together by a film hinge. One material that allows such a structure with a film hinge to be produced is polypropylene. Now, a case made of such a material can only with difficulty exhibit an appearance consistent with what users are expecting of a luxury product. Furthermore, polypropylene is not able to support certain decorations or finishes, such as lacquering, either.

Documents U.S. Pat. No. 6,014,978 and U.S. Pat. No. 5,078,159 describe cases of the same kind in which the connection between the bottom and the lid is via an intermediate element and a multiple hinge structure. There is no means provided for locking the lid with respect to the intermediate element when the latter pivots with respect to the bottom.

Hence, one of the objects of the present invention is to produce a case of the abovementioned type, made in two parts hinged on one another, and which completely or partially solves the problems mentioned hereinabove with reference to the case discussed earlier.

One particular object of the present invention is to produce a makeup case which is hinged by means of a system of articulation that allows the product that it contains to be presented with the lid in a position of maximum opening to 360° with respect to the bottom. More specifically, the subject of the invention is a case which allows the lid to be positioned reliably and stably in the 360°-open position with respect to the bottom. In addition, the invention is aimed at a case which has reliable and durable operation over time. What is more, the invention is aimed at a makeup case which is of satisfactory aesthetic appearance, economical to produce and simple to use.

Other objects still will become apparent from the detailed description which follows.

According to the invention, these objects are achieved by producing a case, in particular a makeup case, comprising a bottom and a lid capable, at least prior to first use, of pivoting with respect to the bottom so as to be positioned underneath the latter, the bottom being hinged about a first axis $A_1$ with respect to an intermediate element, the latter being hinged with respect to the lid about a second axis $A_2$, locking means being capable of locking the lid with respect to the intermediate element when the latter pivots with respect to the bottom about the axis $A_1$, and of locking the bottom with respect to the intermediate element when the latter pivots with respect to the lid about the axis $A_2$.

Because of the ability of the lid to pivot through 360° with respect to the bottom, the case can be displayed in the wide-open position so that its contents are visible immediately to the user. Thus, in this wide-open position, the case can be packaged in a transparent blister and/or displayed at sales outlets. The method of packaging in a blister, folded back at 360°, has the advantage of being able to minimize the area in which the case is stored.

As a preference, the locking means are carried, at least in part, by the intermediate element. The locking means are capable of engaging selectively with complementary first catching means carried by the bottom and with second catching means carried by the lid. Thus, in the position in which the lid is positioned at 360° with respect to the bottom, folding the lid down onto the bottom into the closed position is carried out by partial pivoting of the lid about the second axis, then by partial pivoting about the first axis. The locking means, as appropriate, make it possible to render the first axis inoperative when the pivoting movement is about the second axis, and vice-versa.

According to a beneficial aspect of the invention, the intermediate element has two longitudinal edges. These two edges are preferably parallel to one another, the first axis of articulation being situated near a first edge of the intermediate element. In consequence, the second axis is located near a second edge, opposite the first.

According to one advantageous embodiment, the case consists of a bottom and of a lid, formed as distinct parts, at least one of the axes being formed by a hinge with an attached hinge pin. This has the advantage that the bottom and the lid can be made of two different materials. As a preference, the bottom and the intermediate element are moulded as one from an economically viable material appropriate to the producing of a film hinge, such as polypropylene or some other appropriate polyolefin. As far as the lid is concerned, this is connected, in this case, to the intermediate element, by a hinge with an attached hinge pin. The lid which constitutes the most visible part of the case, may be made of a material other than polypropylene and allowing particular decoration of lacquering to be performed, for example. By way of nonlimiting examples of materials that can be used to make the lid, mention will be made of acrylobutadienestyrene (ABS), polyacrylates, polystyrene, polyoxymethylene (POM) or polystyrene-acrylonitrile (SAN).

According to one particular embodiment, the locking means may comprise at least one member, such as a pip, located on at least one portion of the intermediate element, for example on at least one of the lateral sides of the intermediate element. This locking member is capable of being engaged selectively in a complementary member, for example a corresponding housing, made in a portion of the bottom or in a portion of the lid, respectively. Alternatively, the reverse structure may be envisaged. Thus, a first pip may be located on a portion of the bottom, a second pip being provided on a portion of the lid. In this case, the intermediate element has a housing capable, selectively, of receiving the first or the second pip.

Advantageously, the locking of the bottom with respect to the intermediate element is irreversible. In this case, the intermediate element is immobilized with respect to the bottom and the first axis becomes inoperative. Only the pivoting of the lid on the intermediate piece, about the second axis, is possible, this being over an angular portion which is restricted by comparison with the wide-open angle.

The case at which the invention is aimed is preferably produced in a more or less flat shape and defines a receptacle, delimiting at least one compartment capable of containing a product, particularly a friable product such as a makeup product. Advantageously, the receptacle is shaped to also contain a member for applying the product. In addition, the lid may, on its inside, be equipped with a mirror, allowing the user to look at herself while applying makeup.

As appropriate, the case comprises means capable of allowing the lid to be locked reversibly in the closed position on the bottom.

Figure 1B:
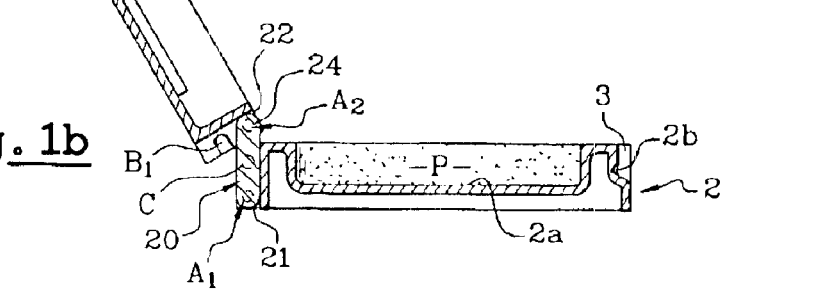
Figure 2A:
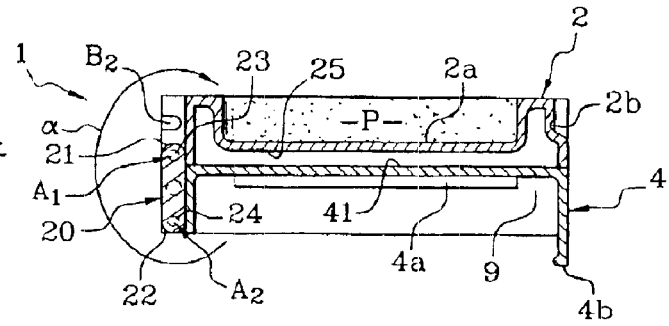
Figure 2B:
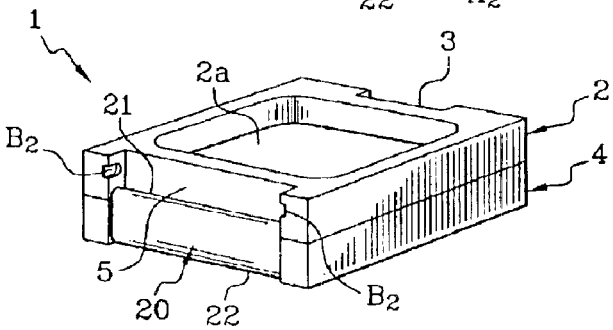
Figure 3A:
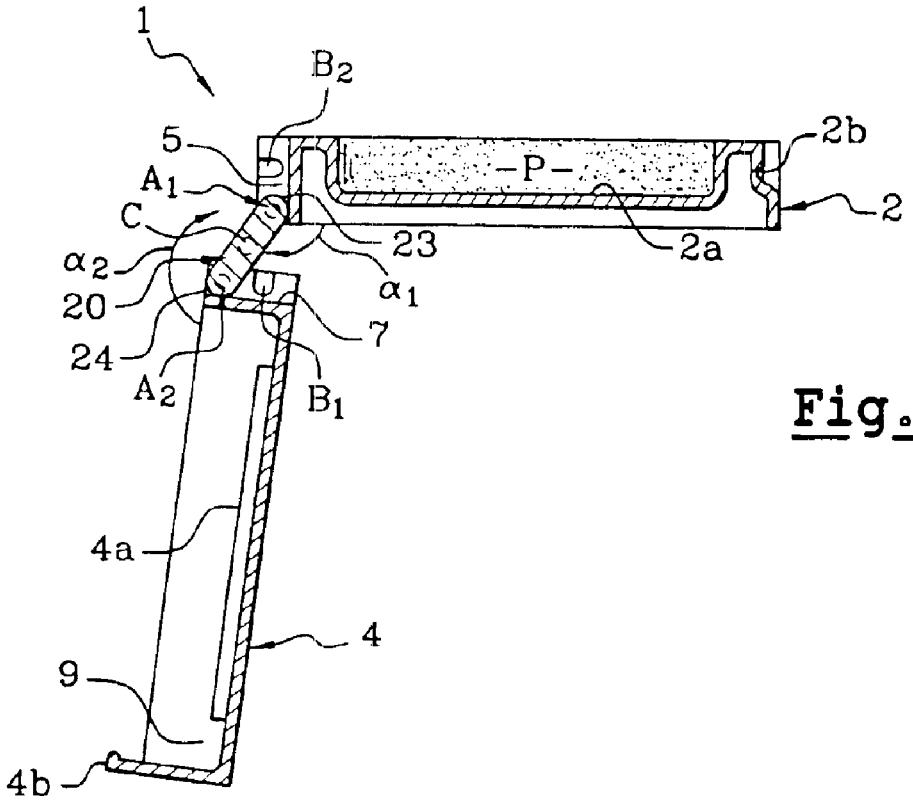
Figure 3B:
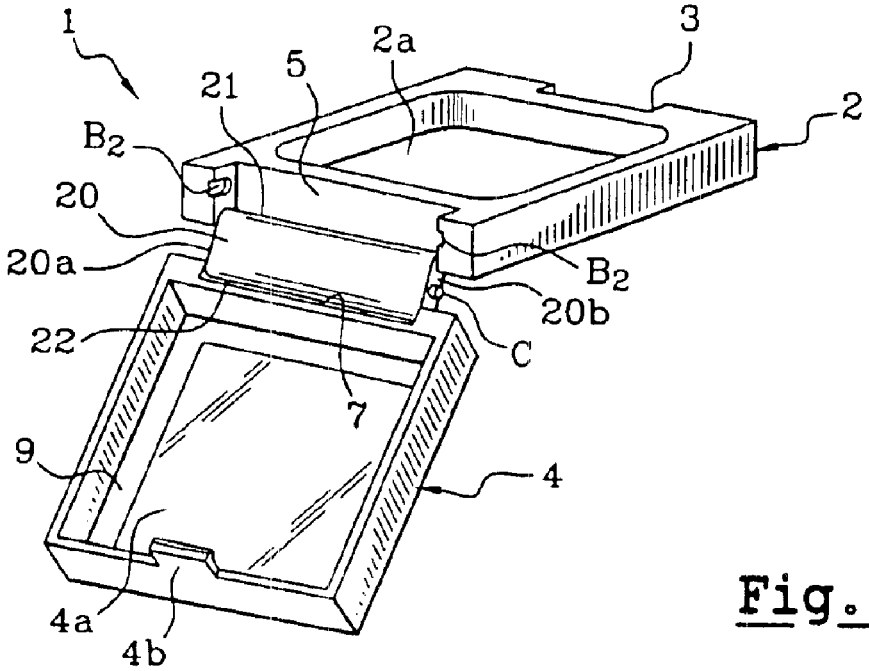
Figure 4A:
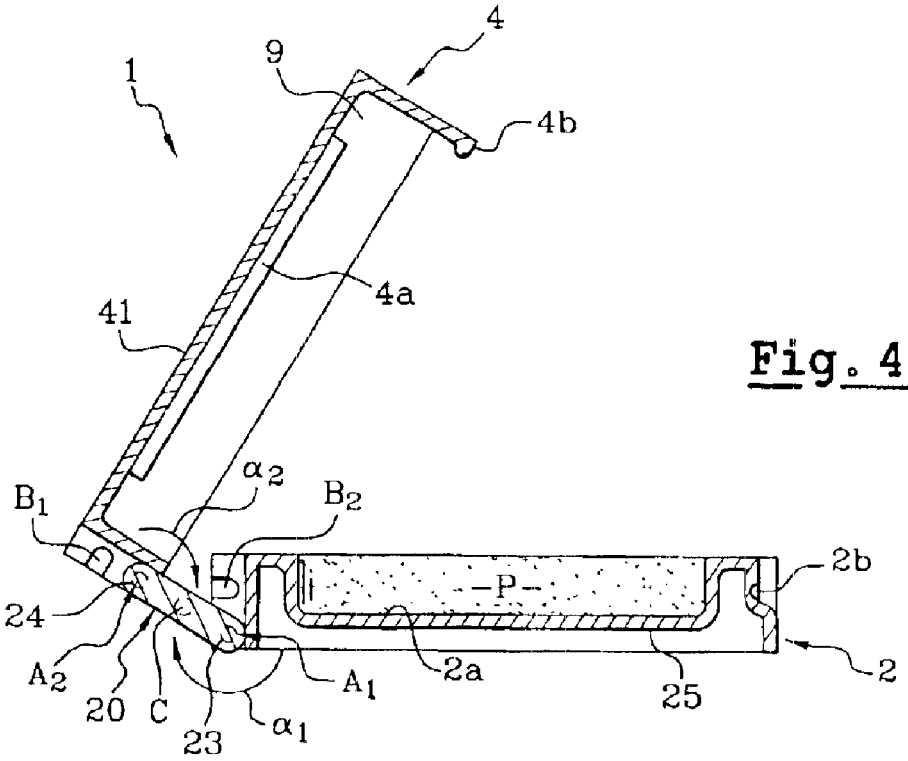
Figure 4B:
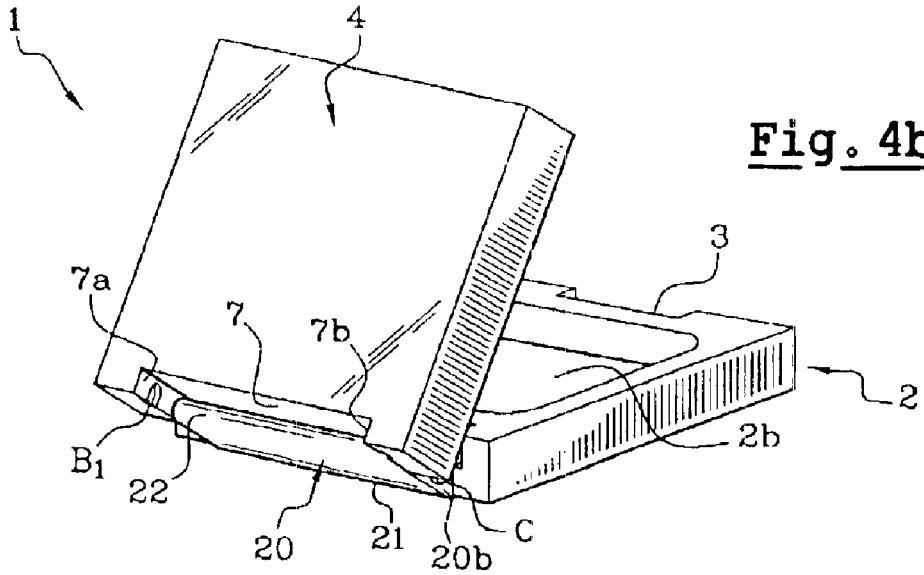
Figure 5A:
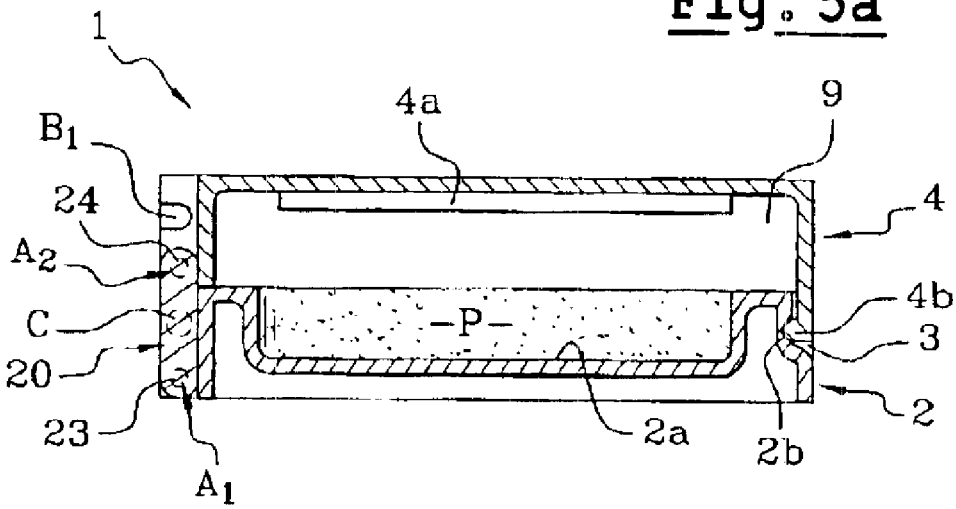
Figure 5B:
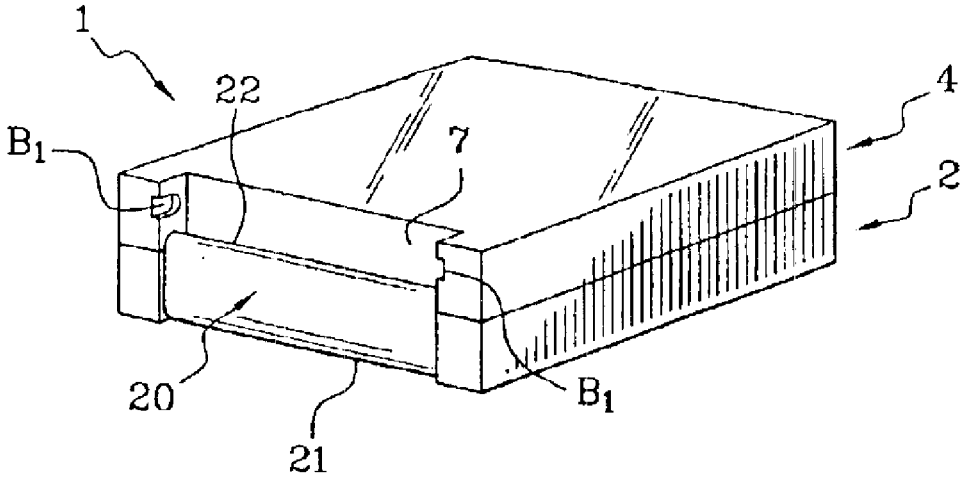
Figure 6:
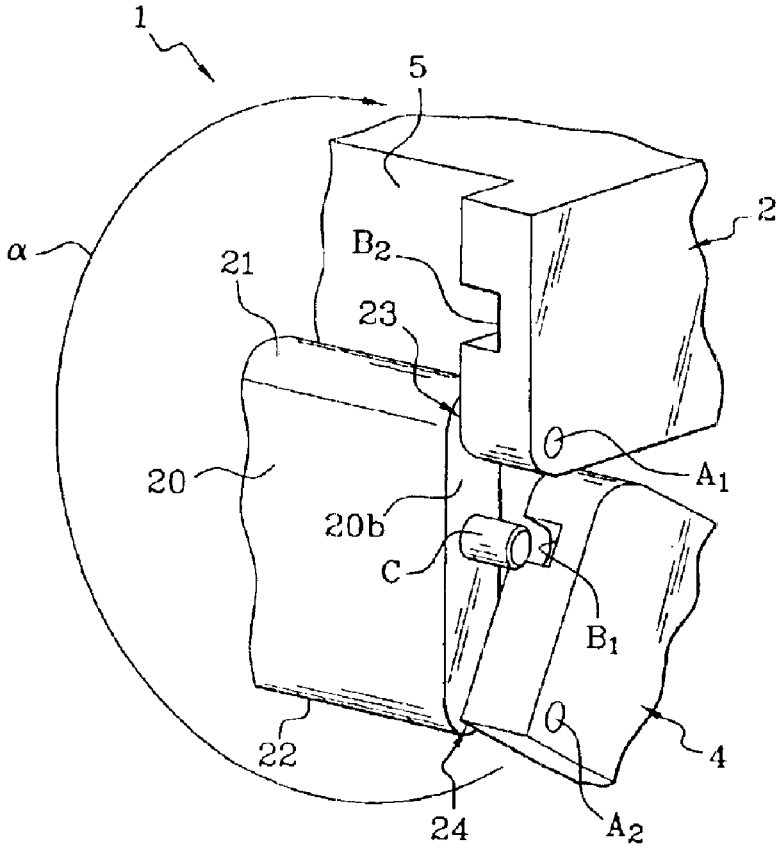
Figure 7:
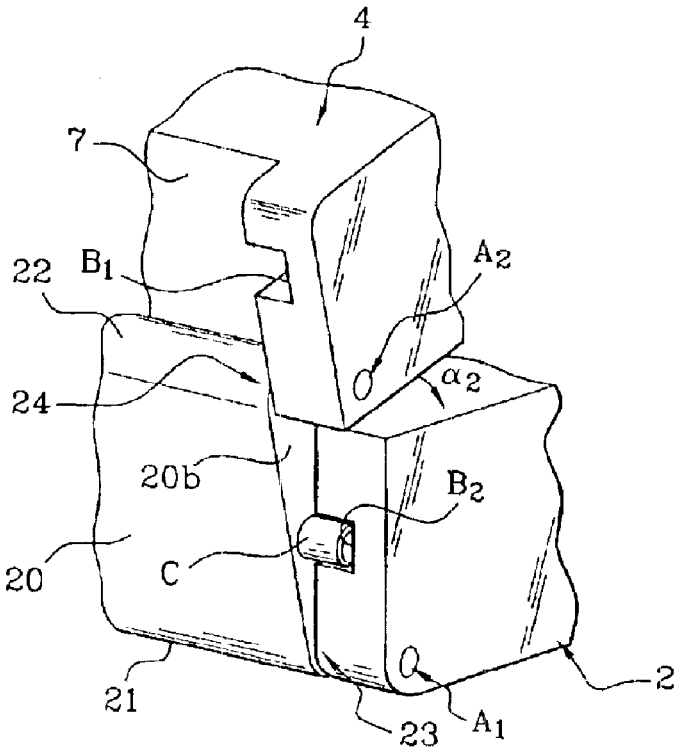
Figure 8A:
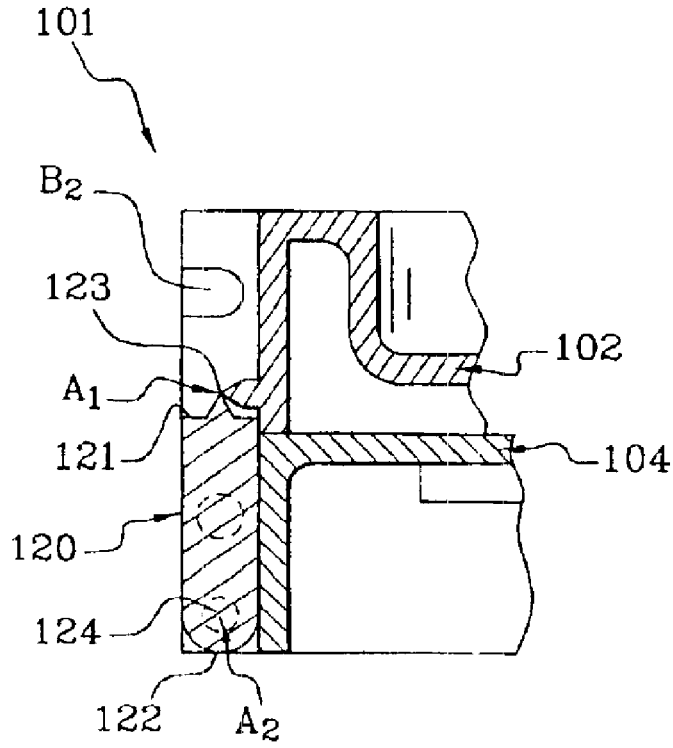
Figure 8B:
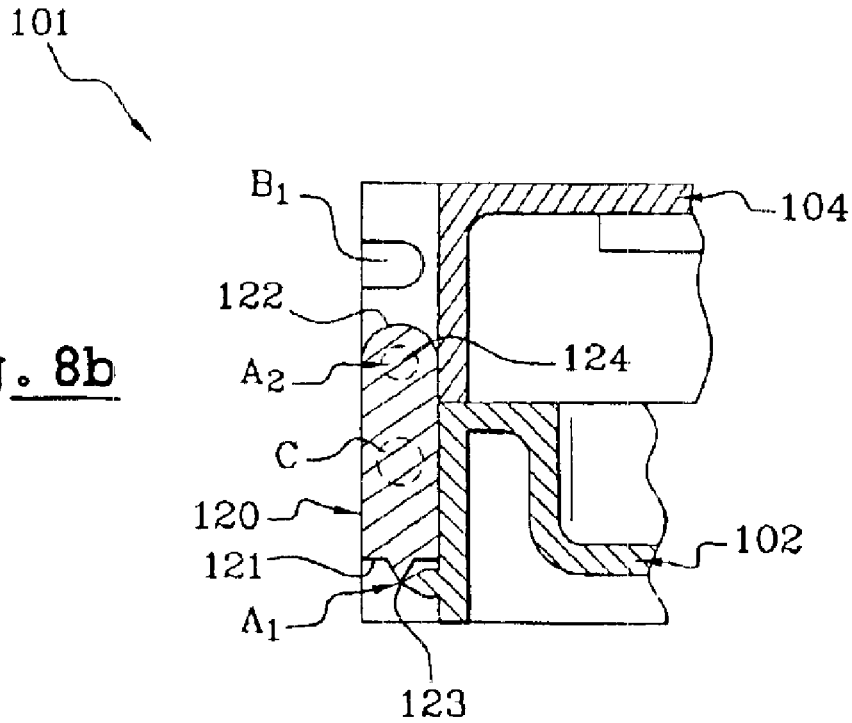

Apart from the provisions set out hereinabove the invention consists in a certain number of other provisions which will be explained hereinafter with regard to some nonlimiting exemplary embodiments which are described with reference to the appended figures, among which:

FIG. 1*a* depicts a perspective view of a case of the makeup case type according to a first embodiment of the invention;

FIG. 1*b* depicts a view in cross section of the case of FIG. 1;

FIGS. 2*a* and 2*b* illustrate the case of FIG. 1 in the 360°-open position;

FIGS. 3*a* and 3*b* respectively depict a view in cross section and a view in perspective of the case of FIG. 1, in a first portion of the movement of the lid from its wide-open position:

FIGS. 4*a* and 4*b* respectively depict a view in cross section and a view in perspective of the case of FIG. 1 in a second portion of the movement of the lid from its wide-open position;

FIGS. 5*a* and 5*b* respectively depict a view in cross section and a view in perspective of the case of FIG. 1, in the closed position;

FIGS. 6 and 7 each show a detailed perspective view of the case of FIG. 1; and FIGS. 8*a* and 8*b* each show a partial perspective view of a case according to a second embodiment of the invention.

Referring in particular to FIGS. 1*a,* 1*b,* 2*a* and 2*b,* a makeup case according to a first embodiment of the invention is denoted by the reference 1. It is of roughly flat shape, as used in particular for packaging makeup products, such as foundations, eyeshadows, blushers or other products of the same type.

FIGS. 1*a* and 1*b* show the case in the position of use. In this position, the lid 4 is open to about 120° with respect to the bottom 2, allowing the user to pick up a dose of product P.

The case 1 is formed mainly from a bottom 2 and from a lid 4, mounted pivoting on the bottom, both obtained by moulding of one or more thermoplastic materials. The bottom 2 forms one or more compartments forming receptacles 2*a* for one or more products P, particularly makeup products. As appropriate, one of the components may be used to house an applicator allowing the product to be picked up and applied to the desired point (not depicted).

The lid 4 has a depression 9 extending over a substantial part of its surface, to accommodate a mirror 4*a*. A clasp 4*b* carried by the lid 4 is capable of engaging with a corresponding member 2*b* carried by the bottom 2 so as to reversibly lock the lid 4 on the bottom 2. Near this locking member 2*b* the bottom 2 forms a cutout 3 so as to make it easier to open the case 1.

The lid 4 is connected to the bottom 2 by means of an intermediate element 20, of elongate shape, and having two longitudinal edges 21, 22. It is laterally delimited by two flanks 20*a,* 20*b* (FIG. 3*b*). As visible in particular in FIGS. 2*a* and 2*b,* the intermediate element 20 is connected to the bottom by a first hinge 23 of the hinge with attached hinge pin type, forming a first axis of articulation $A_1$. This hinge is located on the edge 21 of the intermediate element. Formed on the edge 22 is a second hinge 24 of the same type, forming a second axis of articulation $A_2$. This second hinge 24 connects the intermediate element 2 to the lid 4. Thus, the hinging of the lid via the intermediate element to the bottom is provided by a double hinge structure, the axes of which are parallel.

At one end, the opposite end to the end carrying the clasp 2*b,* the bottom forms a cutout 5 (FIGS. 2*b* and 6) in which the intermediate element 20 is placed. Likewise, a similar cutout 7 is provided at one end of the lid (see FIGS. 3*a* and 7) and is capable of housing the intermediate element 20 in the display position corresponding to the wide-open position (FIGS. 2*a* and 2*b*).

To keep the lid in the position depicted in FIGS. 2*a* and 2*b* with respect to the bottom of the case, locking means C are provided. As illustrated in particular in FIG. 3*b,* the intermediate element 20 comprises two pips C, located on its lateral flanks 20*a* and 20*b*. These pips C are capable of collaborating with recesses $B_1$ made in lateral walls 7*a,* 7*b* of the lid 4. The catching recesses $B_1$ are capable, reversibly, of accommodating the pips C, in which they are held by friction. Similarly, the cutout 5 in the bottom 2 comprises two catching means $B_2$, located on the lateral walls 5*a,* 5*b* of the cutout 5. The catching means $B_2$ are configured to accommodate the pips C, particularly irreversibly, at the time the case is first closed, as will be detailed later on.

Configuring the case in the wide-open position as illustrated in FIGS. 2*a* and 2*b* makes it possible to position the lid under the bottom, so that the top side 41 of the lid 4 faces the underside 25 of the bottom 2. In this position, the case 1 is in the display position, open to an angle of 360°, with respect to the position of the case when closed.

In the display position illustrated in FIGS. 2*a* and 2*b,* the case can be displayed at sales outlets, in such a way to make the product packaged in the compartment 2*a* visible. This position also allows the case to be packaged in a transparent blister. This has the advantage that the product is protected, while at the same time allowing the consumer to choose the desired shade of product without being forced to open the case. The case thus packaged occupies a minimum amount of space.

When the case is packaged in a blister, once the case has been unwrapped, it is therefore in the wide-open position open at 360° (FIGS. 2*a* and 2*b*). In order to be able to use the case, the user pivots the lid with respect to the bottom (in the direction of the arrow cc marked in FIG. 2*a*). While the lid 4 is being pivoted from the display position illustrated in FIGS. 2*a* and 2*b*, it passes, in succession, through the positions shown in FIGS. 3*a* and 3*b* then 4*a* and 4*b* to the closed position illustrated in FIGS. 5*a* and 5*b*. During the pivoting through about 300°, the pips C disengage from the catching recesses $B_1$. At the same time, the intermediate element 20 pivots out of the cutout 7 of the lid. During this pivoting movement, the intermediate element 20 moves closer to the cutout 5 in the bottom.

As shown in greater detail in FIG. 6, the pips C disengage from the catching recesses $B_1$ of the lid and move closer to the catching recesses $B_2$ in the bottom (FIG. 7). The pips C then engage in the catching recesses $B_2$. Advantageously, this engaging takes place irreversibly. Thus, the first axis $A_1$ becomes inoperative, for good.

In order to open and close the case, with a view to using it for makeup, the user performs a pivoting movement only about the axis $A_2$, through an angle $\alpha_2$ (FIG. 1*a*).

FIGS. 5*a* and 5*b* depict the case in the closed position, allowing the product P to be kept sheltered from the outside, or alternatively allowing the case to be carried about in a handbag.

FIGS. 8*a* and 8*b* illustrate another embodiment, whereby a case 101 consists essentially of two elements 102, 104. By comparison with the first embodiment, parts which are identical or perform a similar function, carry the reference numerals of the first embodiment, increased by 100.

By comparison with the first embodiment, the case 101 differs in that the bottom 102 is moulded as one with the intermediate element 120, from an appropriate material. Its configuration and its operation are similar to the case 1 and these will be described again only briefly.

The intermediate element 120 is connected to the bottom 102 by a film hinge 123 forming a first axis of articulation $A_1$. This film hinge becomes inoperative after the first time the case is closed, as described previously with respect to the case 1 in the first embodiment. The hinge 124 is of the same type as the one described earlier and therefore requires no more detailed description.

The structure of the case 101 has the advantage that it is possible, for producing the bottom and the intermediate element, to choose a first economically advantageous material, for example polypropylene. This material allows the production of the film hinge 123. Because this film hinge 123 is located on the bottom 102 of the case, possible whitening of the hinge is not very visible.

As for the lid, advantageously a second plastic material is chosen, this one being capable of receiving special decoration or lacquering. This is important, because the lid is the most visible and valuable part of a makeup case. The second material is chosen, for example, from urea formaldehyde, acrylobutadiene-styrene (ABS), polystyrene-acrylonitrile (SAN), polyoxymethylene (POM), acrylic glasses and polystyrene, etc.

In the foregoing detailed description, reference was made to some preferred embodiments of the invention. Obviously, variations can be made thereto without departing from the spirit of the invention as claimed hereinafter.

What is claimed is:

1. A case, comprising:

a bottom;

a lid pivotable with respect to the bottom so as to be positioned underneath the bottom;

an intermediate element, wherein the bottom is hinged about a first axis with respect to the intermediate element and the intermediate element is hinged with respect to the lid about a second axis; and locking means for locking the lid with respect to the intermediate element when the intermediate element pivots with respect to the bottom about the first axis and for locking the bottom with respect to the intermediate element when the intermediate element pivots with respect to the lid about the second axis.

2. The case according to claim 1, wherein the locking means are carried by the intermediate element and are selectively engageable with complementary first catching means carried by the bottom and with second catching means carried by the lid.

3. The case according to claim 1, wherein the intermediate element has first and second longitudinal edges, the first axis being located near the first edge of the intermediate element and the second axis being located near the second edge opposite the first edge.

4. The case according to claim 3, wherein the first axis is substantially parallel to the second axis.

5. The case according to claim 1, wherein at least one of the first axis and the second axis comprises a hinge with an attached hinge pin.

6. The case according to claim 5, wherein the bottom and the intermediate element are connected by a film hinge, and wherein the lid is connected to the intermediate element by the hinge with the attached hinge pin.

7. The case according to claim 1, wherein the lid is made of a material chosen from urea formaldehyde, acrylobutadiene-styrene, polystyrene-acrylonitrile, polyoxymethylene, acrylic glass, and polystyrene.

8. The case according to claim 1, wherein the locking means comprise at least one pip located on at least one lateral portion of the intermediate element, the pip being shaped to selectively engage a corresponding first recess in a portion of the bottom and a corresponding second recess in a portion of the lid.

9. The case according to claim 1, wherein locking of the bottom with respect to the intermediate element is irreversible.

10. The case according to claim 1, further comprising a receptacle in the bottom delimiting at least one compartment configured to contain at least one product.

11. The case according to claim 1, further comprising means for reversibly locking the lid in a closed position on the bottom.

12. The case according to claim 1, further comprising at least one product contained in the case, wherein the product is a friable product.

13. The case according to claim 1, further comprising at least one cosmetic product contained in the case.

14. The case according to claim 13, wherein the cosmetic product is a makeup product.

15. The case according to claim 13, wherein the cosmetic product is friable.

16. A case, comprising:

a bottom having a first surface and a second surface;

an intermediate element pivotably connected to the bottom along a first axis;

a lid pivotably connected to the intermediate element along a second axis, wherein the lid is pivotable with respect to the bottom between a first position, in which the lid is closer to the first surface of the bottom than to the second surface of the bottom, and a second position, in which the lid is closer to the second surface of the bottom than to the first surface of the bottom; and locking means for locking the lid with respect to the intermediate element when the lid is in the first position, and for locking the bottom with respect to the intermediate element when the lid is in the second position.

17. The case according to claim 16, wherein the bottom is pivotally connected to the intermediate element via a first hinge and the lid is pivotally connected to the intermediate element via a second hinge.

18. The case according to claim 17, wherein the first hinge comprises one of a hinge with an attached hinge pin and a film hinge.

19. The case according to claim 16, wherein the first axis is substantially parallel to the second axis.

20. The case according to claim 16, wherein the locking means are disposed on the intermediate element.

21. The case according to claim 20, wherein the locking means are located between the first axis and the second axis.

22. The case according to claim 20, wherein the locking means comprise at least one projection selectively engageable with a respective recess on the bottom and a respective recess on the lid.

23. The case according to claim 16, wherein locking of the bottom with respect to the intermediate element is irreversible.

24. The case according to claim 16, wherein the lid is made of a material chosen from urea formaldehyde, acrylobutadiene-styrene, polystyrene-acrylonitrile, polyoxymethylene, acrylic glass, and polystyrene.

25. The case according to claim 16, wherein the bottom further comprises a receptacle delimiting at least one compartment configured to contain at least one product.

26. The case according to claim 25, further comprising at least one product contained in the case, wherein the at least one product is a cosmetic product.

27. The case according to claim 16, further comprising means for reversibly locking the lid in the second position.

28. A case, comprising:

a bottom;

a lid pivotable with respect to the bottom so as to be positioned underneath the bottom;

an intermediate element, wherein the bottom is hinged about a first axis with respect to the intermediate element and the intermediate element is hinged with respect to the lid about a second axis; and a locking member configured to lock the lid with respect to the intermediate element when the intermediate element pivots with respect to the bottom about the first axis, the locking member also being configured to lock the bottom with respect to the intermediate element when the intermediate element pivots with respect to the lid about the second axis.

29. A case, comprising:

a bottom having a first surface and a second surface;

an intermediate element pivotably connected to the bottom along a first axis;

a lid pivotably connected to the intermediate element along a second axis, wherein the lid is pivotable with respect to the bottom between a first position, in which the lid is closer to the first surface of the bottom than to the second surface of the bottom, and a second position, in which the lid is closer to the second surface of the bottom than to the first surface of the bottom; and a locking member configured to lock the lid with respect to the intermediate element when the lid is in the first position, the locking member also being configured to lock the bottom with respect to the intermediate element when the lid is in the second position.

* * * * *

UNITED STATES PATENT AND TRADEMARK OFFICE

CERTIFICATE OF CORRECTION

PATENT NO. : 6,901,937 B2
DATED : June 7, 2005
INVENTOR(S) : Jacques Sebban

It is certified that error appears in the above-identified patent and that said Letters Patent is hereby corrected as shown below:

Title page,
Item [22], PCT Filing Date, "PCT Filed: May 22, 2001" should read
-- PCT Filed: March 22, 2001 --.

Signed and Sealed this

Ninth Day of August, 2005

JON W. DUDAS
*Director of the United States Patent and Trademark Office*